US007466963B2

(12) United States Patent
Liang

(10) Patent No.: US 7,466,963 B2
(45) Date of Patent: Dec. 16, 2008

(54) PAPER RACK WITH FUNCTIONS OF ACCESSING AND PLAYING MULTIMEDIA FILES

(76) Inventor: Hsien-Rong Liang, P.O. Box No. 6-57, Junghe, Taipei 235 (TW)

( * ) Notice: Subject to any disclaimer, the term of this patent is extended or adjusted under 35 U.S.C. 154(b) by 746 days.

(21) Appl. No.: 11/146,059

(22) Filed: Jun. 7, 2005

(65) Prior Publication Data

US 2007/0011341 A1 Jan. 11, 2007

(51) Int. Cl.
*H04B 1/38* (2006.01)

(52) U.S. Cl. ..... 455/90.3; 242/599; 242/564.2; 242/590; 242/598.6; 242/905

(58) Field of Classification Search ..... 455/90.3; 242/599, 564.2, 590, 598.6, 905
See application file for complete search history.

(56) References Cited

U.S. PATENT DOCUMENTS 5,499,008 A * 3/1996 Rosenkrantz et al. .... 340/384.7
6,000,658 A * 12/1999 McCall, Jr. ..... 242/599
7,040,566 B1 * 5/2006 Rodrian et al. ..... 242/563
2003/0189127 A1 * 10/2003 Arendt et al. ..... 242/598.5
2005/0171634 A1 * 8/2005 York et al. ..... 700/231
2006/0157496 A1 * 7/2006 Tagliareni ..... 221/63
2006/0173576 A1 * 8/2006 Goerg et al. ..... 700/236

* cited by examiner

*Primary Examiner*—Matthew D Anderson
*Assistant Examiner*—April S Guzman

(57) ABSTRACT

A paper rack with functions of accessing and playing multimedia files is provided, wherein a circuit board has transmission junctions, sockets, and a wireless receiver and emitter for connecting with a digital information equipment, a memory card, a wireless network, and a wireless receiving and emitting device, and transmitting a digital file and a multimedia file. A hard disk for storing a digital file and a multimedia file is also included in the paper rack. Moreover, a control and data processing for the aforementioned components connected can be performed through a touch screen and a control button, and the corresponding digital files and multimedia files can be further played with the touch screen, a liquid crystal display unit, and a speaker.

6 Claims, 9 Drawing Sheets

PAPER RACK WITH FUNCTIONS OF ACCESSING AND PLAYING MULTIMEDIA FILES

BACKGROUND OF THE INVENTION (a) Field of the Invention

The present invention relates to a paper rack with functions of accessing and playing multimedia files, and more particularly to a paper rack wherein an internal circuit board has transmission junctions, sockets, and a wireless receiver and emitter for connecting with a digital information equipment (such as a personal digital assistant, a portable disk, or a card reader), a memory card, a wireless network, or a wireless receiving and emitting device, and transmitting a digital file and a multimedia file.

(b) Description of the Prior Art

As shown in FIG. 1, a conventional paper rack A has a roll of toilet paper B, allowing for a user to directly extract the toilet paper from the roll B in usage. Moreover, most of the paper rack A installed with a roll of toilet paper B are used in a bathroom. However, most of people will choose to read a paper or magazine upon using the bathroom wherein a light is only used for purely lightening, and therefore easy to cause ache in eyes.

Moreover, a paper rack A installed with a roll of toilet paper B is widely applied in places such as kitchens, bed rooms, living rooms, bathrooms, ordinary families, companies, or even a public place like a hotel, and most of the places having a paper rack A are a space for personal use. Therefore, how to change that only a single activity of reading a paper or magazine can be taken in the aforementioned places, and in the meantime to increase a function of the paper rack, is a problem which needs to be solved by the inventor.

SUMMARY OF THE INVENTION

The present invention is to provide a paper rack with functions of accessing and playing multimedia files, and more particularly to a paper rack wherein an internal circuit board has transmission junctions, sockets, and a wireless receiver and emitter for connecting with a digital information equipment (such as a personal digital assistant, a portable disk, or a card reader), a memory card, a wireless network, or a wireless receiving and emitting device, and transmitting a digital file and a multimedia file. A hard disk for storing a digital file and a multimedia file is also included in the paper rack. Moreover, a control and data processing for the aforementioned components connected can be performed through a touch screen and a control button, and the corresponding digital files and multimedia files can be further played with the touch screen, a liquid crystal display unit, and a speaker.

In addition, a transmission control circuit on the circuit board is connected with the aforementioned sockets, wireless transmission circuit, transmission junctions, and transmission interface, and performs accessing and transmission of the digital files and multimedia files between the connected memory card, wireless receiver, or digital information equipment and the hard disk, wherein the liquid crystal display unit will display a connection status and data processing function between the aforementioned components, so as to enable a selection of the corresponding data processing functions with the control button, and to enable the transmission of the control signal selected to a micro processor.

On the other hand, the touch screen has a fixing rack that is used to connect with the paper rack with functions of accessing and playing multimedia files, and a fixing junction that is used to connect with a transmission connector on the rack.

Accordingly, the micro processor inside the circuit board is used to process a control signal, data transmission signal, and data computation between the aforementioned components inside the circuit board. On the other hand, the external touch screen is connected with the aforementioned micro processor and transmission control circuit, and transmits the control signal corresponding to a data processing function to be displayed to the aforementioned micro processor, with the digital files and multimedia files, which are transmitted by the aforementioned transmission control circuit, played and further displayed on the aforementioned liquid crystal display unit. Moreover, the speaker is used to play an audio signal of the audio digital files and multimedia files.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
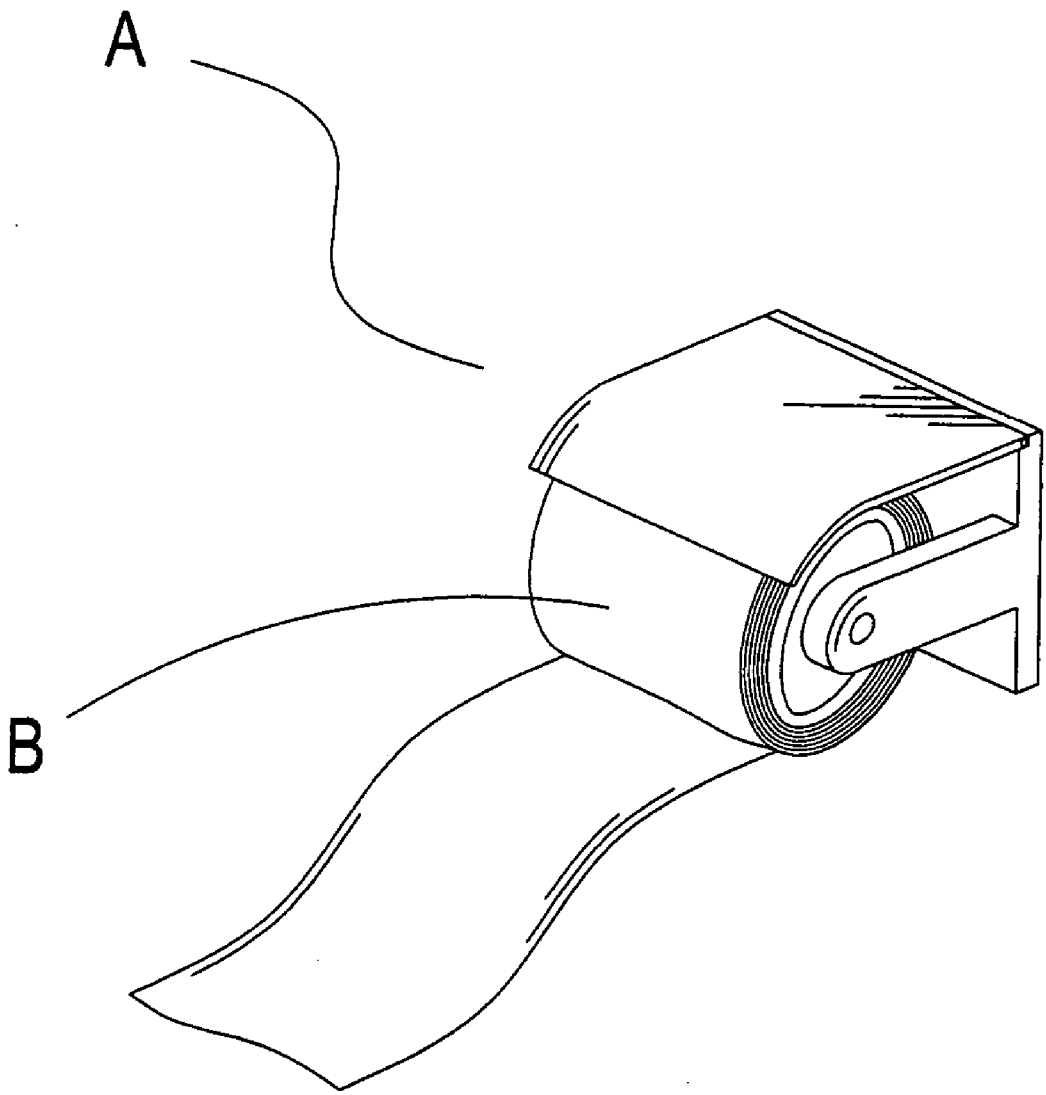
FIG.1 Prior Art
FIG. 1 shows a perspective view of a conventional paper rack.
Figure 2:
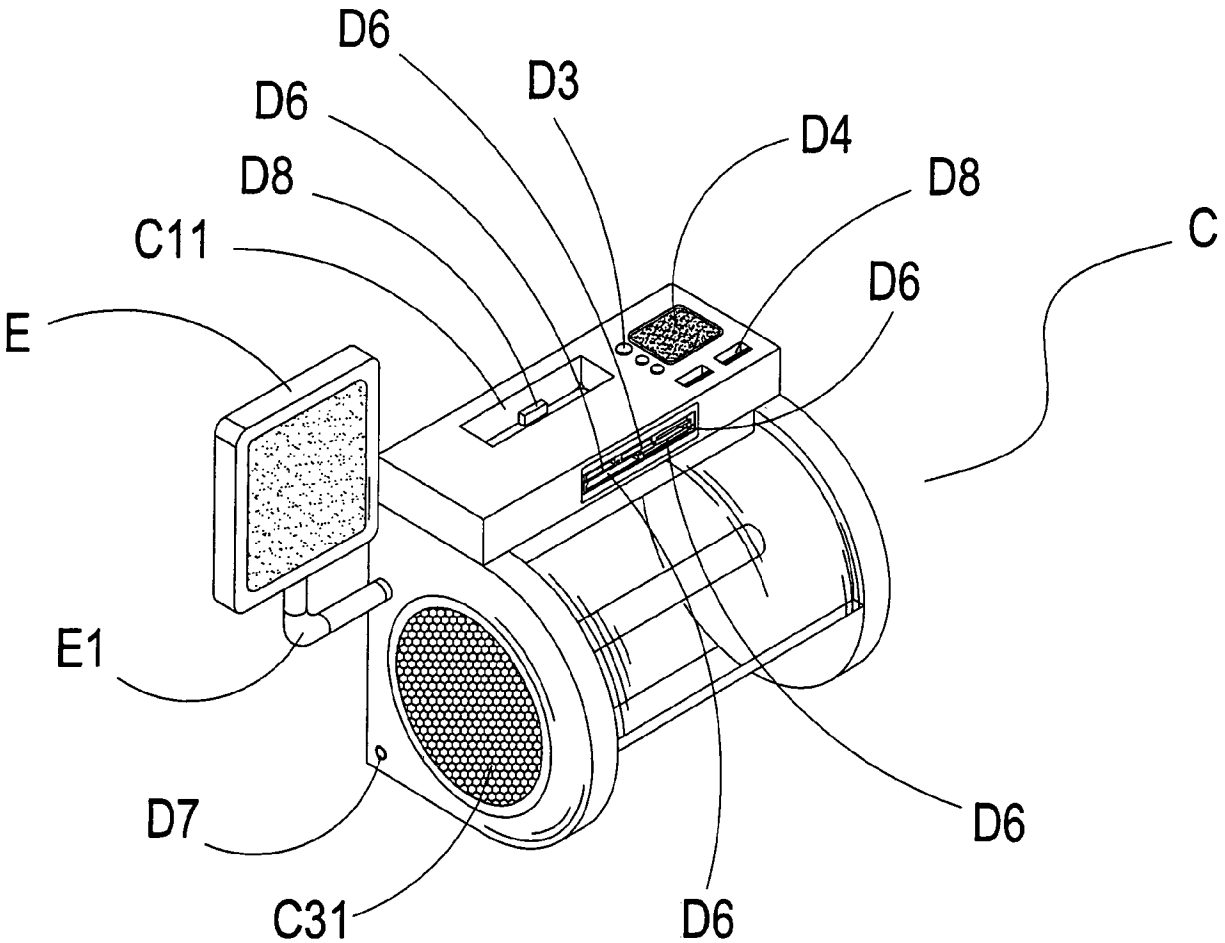
FIG. 2 shows a perspective view of the present invention.
Figure 3:
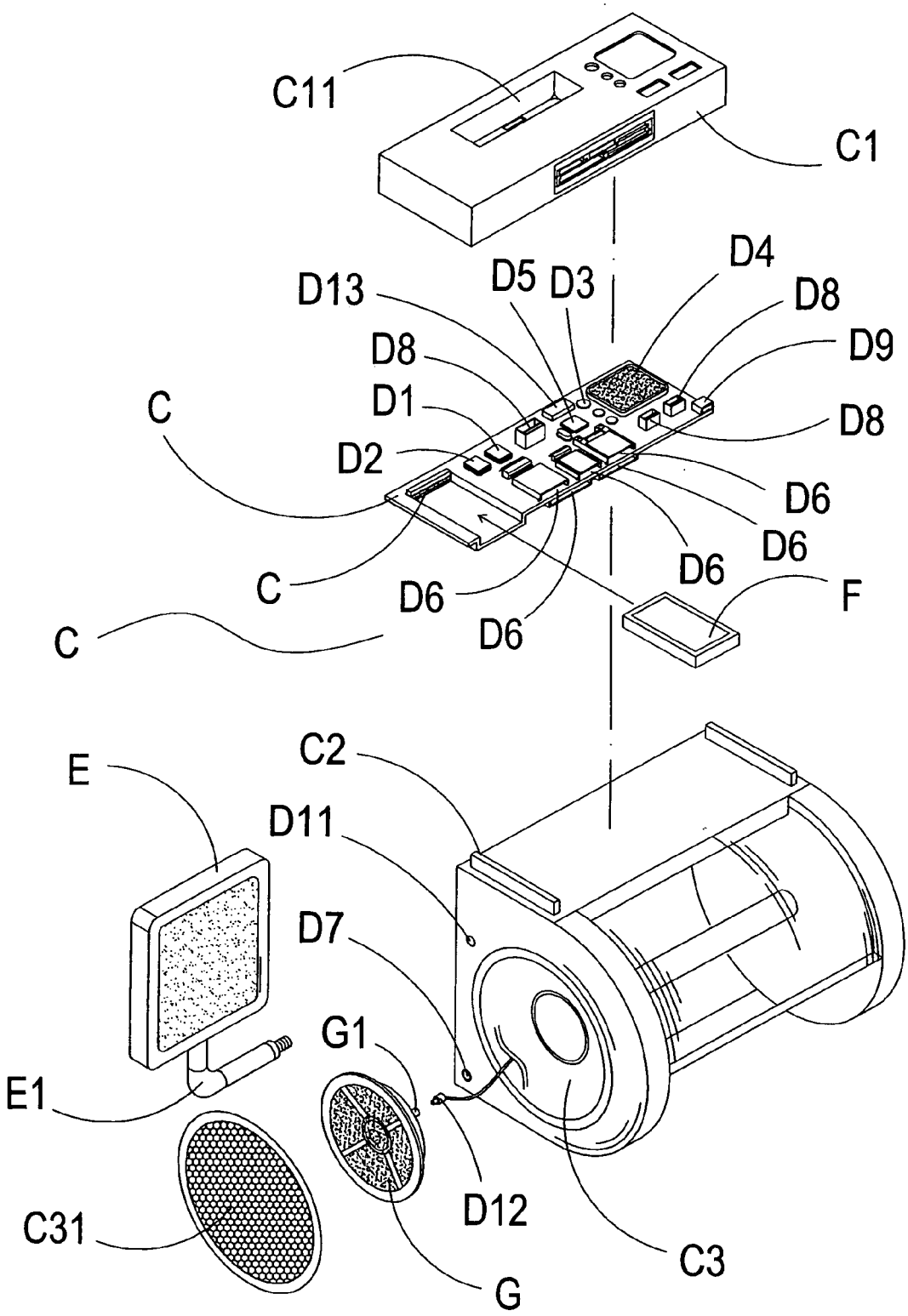
FIG. 3 shows an assembly view of the present invention.
Figure 4:
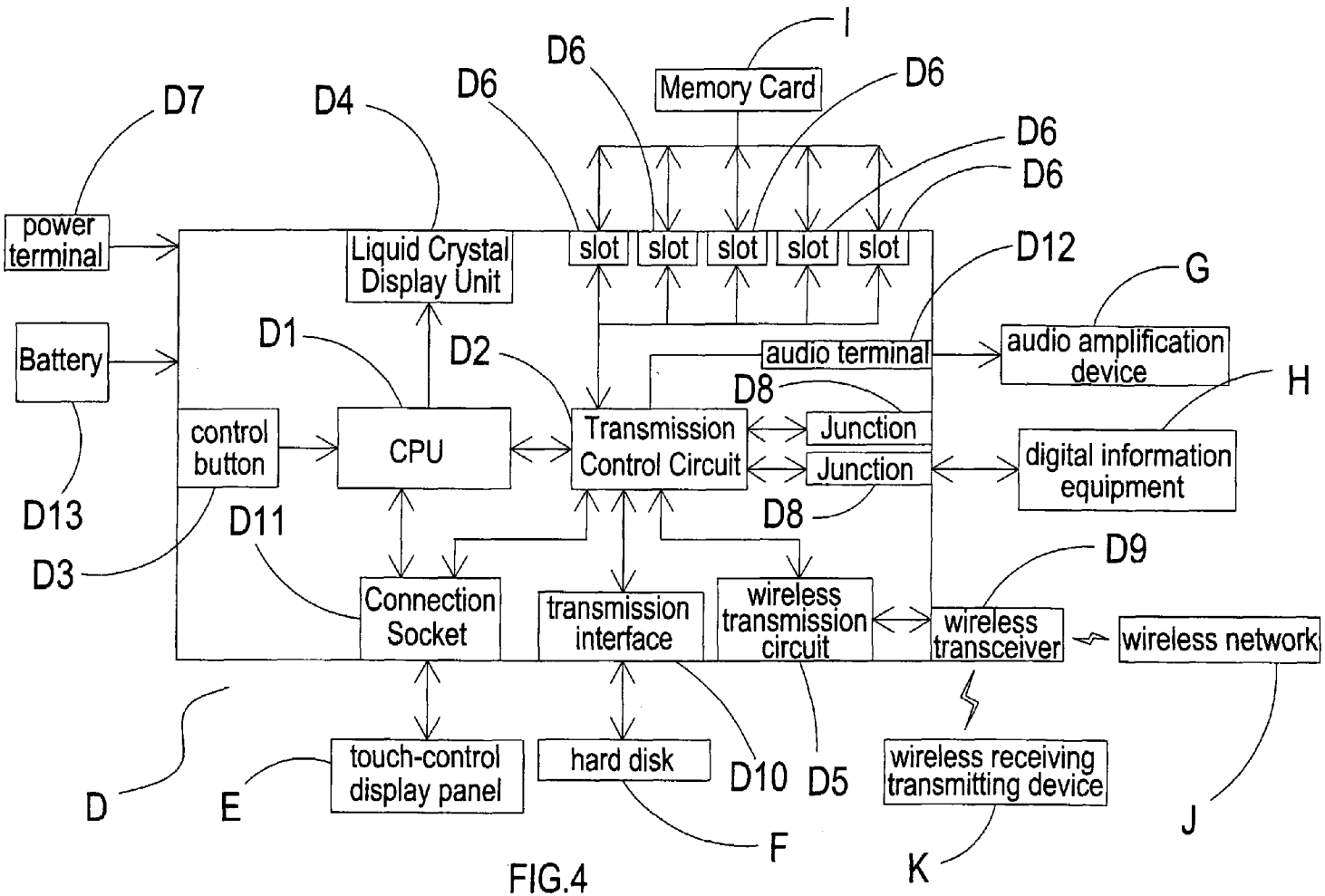
FIG. 4 shows a block diagram of a connection of a circuit board of the present invention.
Figure 5:
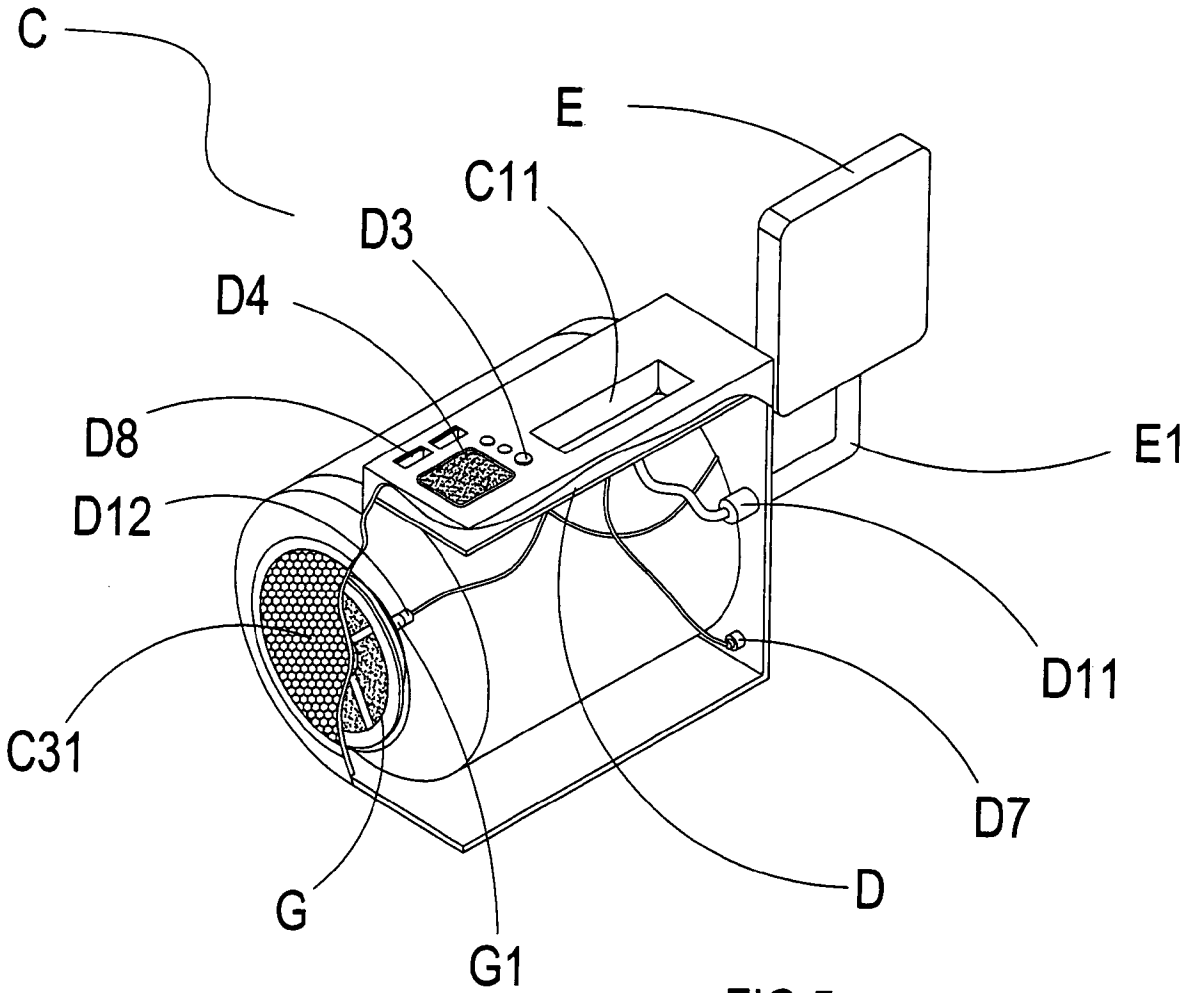
FIG. 5 shows a partial cross sectional view of the present invention.

Referring to FIG. 2 and FIG. 3, the primary object of the present invention is to provide a paper rack with functions of accessing and playing multimedia files, wherein a circuit board D is installed on a fixing piece C2 of a paper rack with functions of accessing and playing multimedia files C, and is covered by a casing C1. A speaker G is installed inside a containing slot C3 at one side, and is covered by a casing C31 (as shown in FIG. 4 and FIG. 5).

A micro processor D1, a transmission control circuit D2, a control button D3, a liquid crystal display unit D4, a wireless transmission circuit D5, a plurality of sockets D6, a power junction D7, a plurality of transmission junctions D8, a wireless receiver and emitter D9, a transmission interface D10, a connector D11, an audio junction D12, and a battery D13 are installed on the circuit board D, wherein the power junction D7 and the connector D11 are located on the paper rack with functions of accessing and playing multimedia files C.

A plurality of sockets D6 corresponding to different specifications of memory cards I are connected with the memory cards I of corresponding specifications, and digital files and multimedia files inside the aforementioned memory cards I are accessed and played.

The wireless transmission circuit D5 is connected with the wireless receiver and emitter D9, so as to transmit a wireless signal J1 between a wireless network J and a wireless receiving and emitting device K, in order to access and transmit the digital files and multimedia files.

Some of the transmission junctions D8 are emplaced inside the casing C1, while others are located on the circuit board D. They are directly connected with digital information equipment H, and are used to access and transmit digital files and multimedia files inside the digital information equipment H.

The transmission interface D10 is connected with a hard disk F with specifications corresponding to data stored, and is used to access and transmit digital files and multimedia files inside the hard disk F.

The transmission control circuit D2 is connected with the aforementioned sockets D6, wireless transmission circuit D5, transmission junctions D8, and transmission interface D10, and is used to access and transmit digital files and. multimedia files between the memory cards I to be connected, the wireless receiver and emitter D9, the digital information equipment H, and the hard disk F.

The liquid crystal display unit D4 is used to display a connection status and data processing function between the aforementioned components, so as to enable a selection of corresponding data processing function with the control button D3, and to transmit the control signal selected to the micro processor D1, which is used to process the control signal, data transmission signal, and data computation between the aforementioned components inside the circuit board D.

The touch screen E has a fixing rack E1 used to connect with the paper rack with functions of accessing and playing multimedia files C, and a fixing junction E2 used to connect with the transmission connector D11 on the paper rack C. On the other hand, the touch screen is connected with the aforementioned micro processor D1 and transmission control circuit D2, and is used to transmit the control signal corresponding to data processing function to the aforementioned micro processor D1, and to play the digital files and multimedia files transmitted by the aforementioned transmission control circuit D2. In addition, the digital files and multimedia files are further displayed on the aforementioned liquid crystal display unit D4, and the speaker G is used to play an audio signal of the audio digital files and multimedia files. The aforementioned speaker G has a connecting port G1 which is used to connect with the audio junction D12 on the circuit board D.

The power junction D7 is connected with a DC/AC transformer, to transmit an external power to the circuit board D, thereby providing a working power for the aforementioned circuit board D. The battery D13 is located on the circuit board D, so as to enable the aforementioned circuit board to operate as usual when there is no external power. The battery D13 can also be charged through the aforementioned power junction D7.

Figure 6:
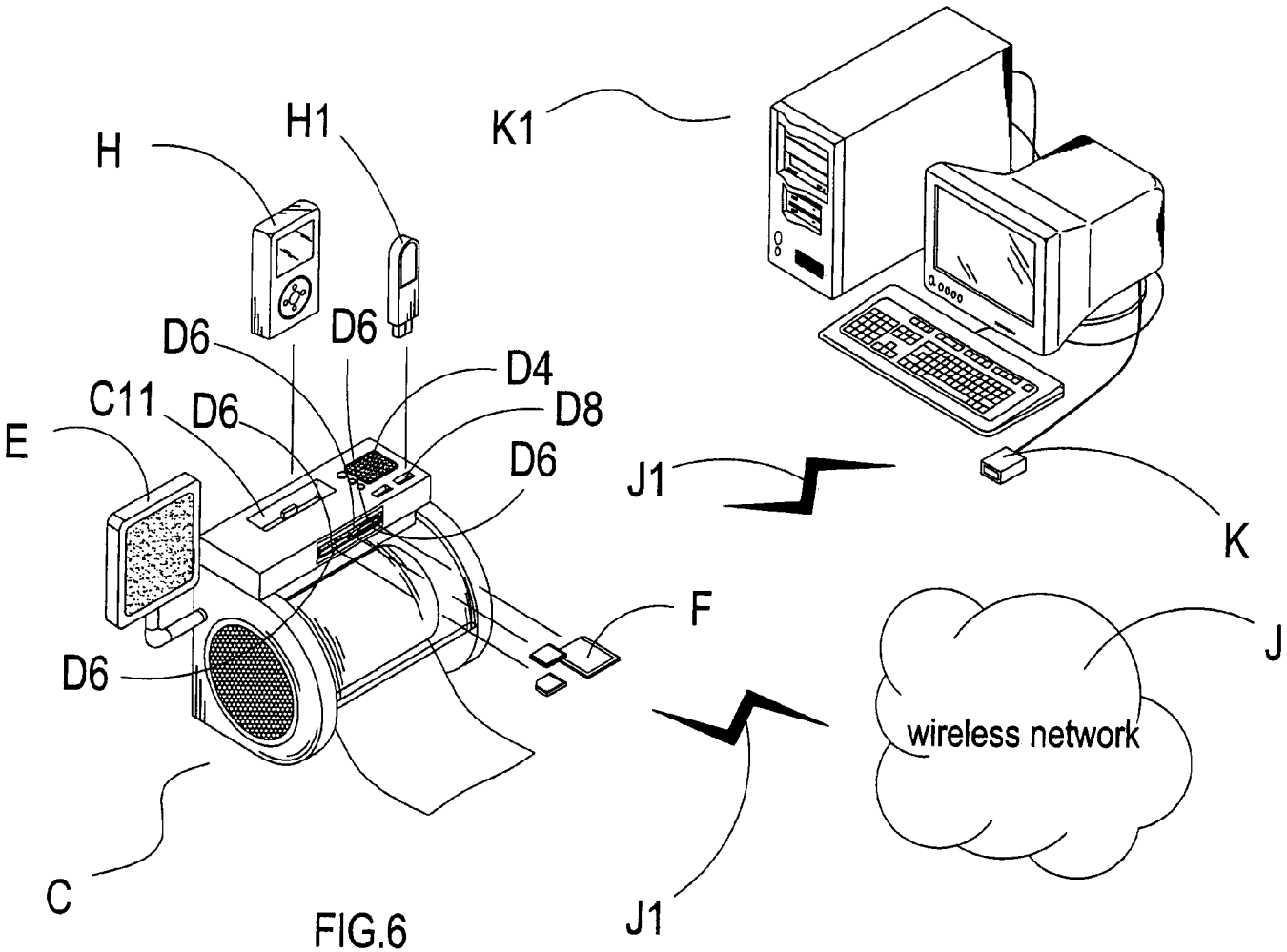
FIG. 6 shows a schematic view of an implementation of the present invention.

Referring to FIG. 6 (along with FIG. 4), a memory card I is inserted into a socket D6 with a corresponding specification, and a digital information equipment H is inserted on a transmission junction D8 inside a connection slot C11, whereas a portable disk H1 is inserted on another transmission junction D8.

A wireless transmission circuit D5 and a wireless receiver and emitter D9, which are installed on a circuit board D inside a paper rack with functions of accessing and playing multimedia files, are connected with a wireless network J and an equipment having a wireless receiving and emitting device K such as a personal computer K1, and can transmit and access data with a wireless signal J1.

Of the aforementioned connection, related control such as data conversion, accessing, editing, and playing can be performed between the aforementioned devices such as the digital information equipment H, the portable disk H1, the memory card I, the wireless network, and the personal computer K1, through a touch screen E and a control button D3. Moreover, data transmission and accessing can be further performed between a hard disk F inside a paper rack with functions of accessing and playing multimedia files and the aforementioned devices. On the other hand, the touch screen E and a liquid crystal display unit D4 can display contents of digital files and multimedia files to be played, and a speaker G can play audio signals.

The sockets D6 are corresponding to memory cards of different specifications I, such as a CF card (Compact Flash Memory Card), a Type-I CF card (Compact Flash Memory Card), a Type-II Card (Compact Flash Memory Card), an MS card (Memory Stick Memory Card), an MGMS card (Magic Gate Memory Stick Memory Card), a Duo-MS card (Duo Memory Stick Memory Card), a Pro-MS card (Pro Memory Stick Memory Card), an MMC card (Multi-Media Memory Card), an MMC 4.0 card (Multi-Media Memory Card Ver 4.0), a RSMMC card (Reduced Size Multi-Media Memory Card), an SD card (Secure Digital Memory Card), a Mini SD card (Mini Secure Memory Card), an SM card (Smart Media Memory Card), an Xd card (extreme Digital Picture Memory Card), and digital information storage media with related specification.

The transmission junctions D8 are further to be an USB port (Universal Serial Bus), an IEEE 1394 (Institute of Electrical and Electronic Engineers Standard Bus Interface) and SATA (Serial Advanced Technology Attachment) port, and a related connection and transmission port for digital information.

The wireless transmission circuit D5 and the wireless receiver and emitter D9 are corresponding to different devices of wireless transmission signal J1, including an infra-red device, a Blue-tooth device, an FM (Frequency Modulation) device, an AM (Amplitude Modulation) device, a GPRS (General Packet Radio Service) device, a CDMA (Code Division Multiple Access) device, a GSM (Global System for Mobile Communication) device, and a related device applied in wireless signal transmission techniques.

The wireless network J to be connected is further an 802.11 wireless network and a general wireless network connected with a related wireless transmission method.

The transmission interface D10 is corresponding to the hard disk with specifications of an IDE (Integrated Device Electronics) interface, a SCSI (Small Computer Standard Interface) interface, an SATA (Serial Advanced Technology Attachment) interface, and a related hard disk transmission and connection interface.

The digital information equipment to be connected is further a PDA (Personal Digital Assistant), a portable disk, a card reader, a multimedia walkman, and related digital information equipment.

The transmission control circuit is further a USB-OTG (Universal Serial Bus-ON-TO-GO) circuit, and a related transmission interface integrated control circuit.

Figure 7:
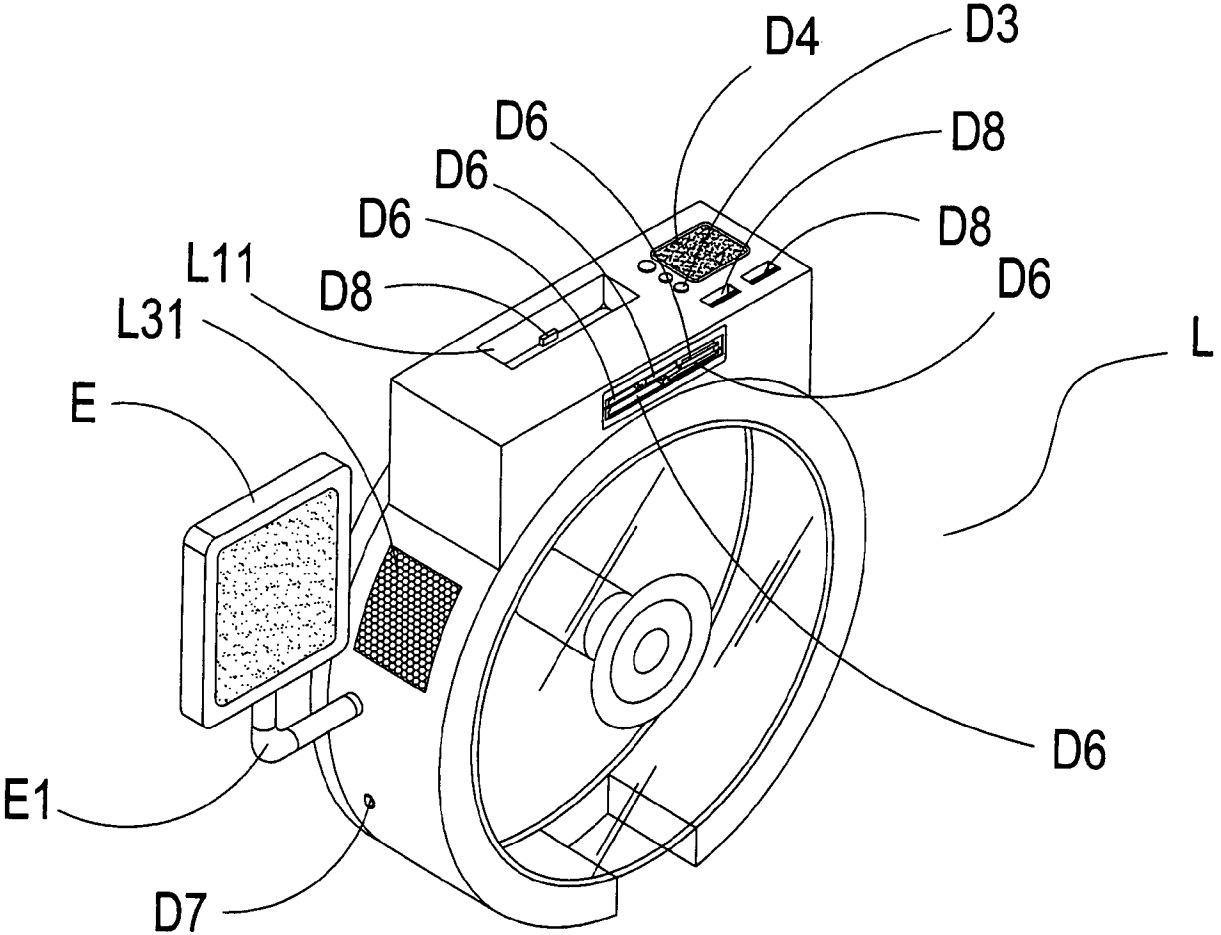
FIG. 7 shows a schematic view of a further implementation of the present invention.
Figure 8:
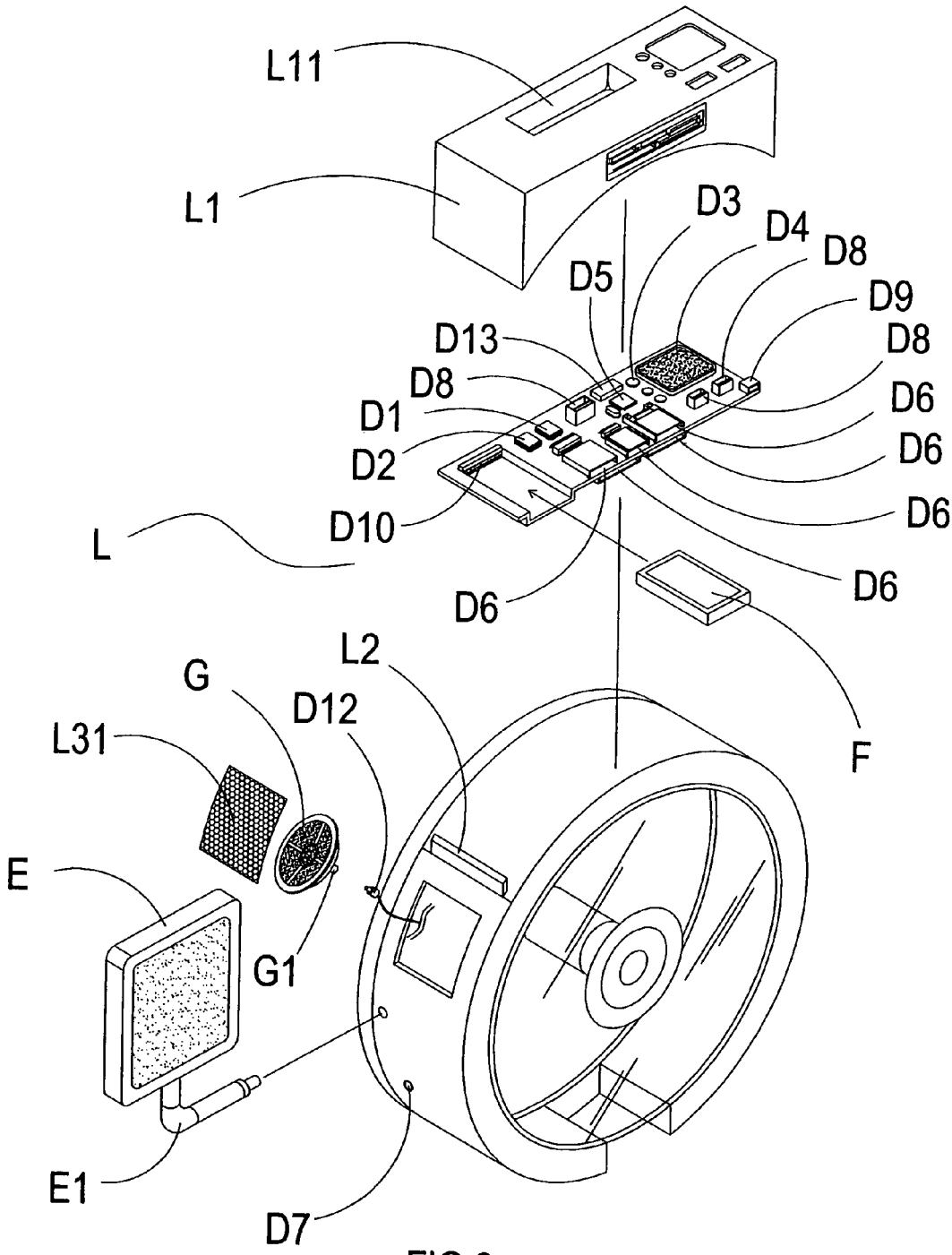
FIG. 8 shows an assembly view of a further implementation of the present invention.

Referring to FIG. 7 and FIG. 8, it shows another type of paper rack with functions of accessing and playing multimedia files L wherein a circuit board D is installed on a fixing piece L2 of the paper rack with functions of accessing and playing multimedia files L, and is covered by a casing L1. A speaker G is installed inside a containing slot L3 at one side, and is covered by a casing L31 (as shown in FIG. 4).

A micro processor D1, a transmission control circuit D2, a control button D3, a liquid crystal display unit D4, a wireless transmission circuit D5, a plurality of sockets D6, a power junction D7, a plurality of transmission junctions D8, a wireless receiver and emitter D9, a transmission interface D10, and a connector D11, wherein the power junction D7 and the connector D11 are located on the paper rack with functions of accessing and playing multimedia files L.

A plurality of sockets D6 corresponding to different specifications of memory cards I are connected with the memory cards I of corresponding specifications, and digital files and multimedia files inside the aforementioned memory cards I are accessed and played.

The wireless transmission circuit D5 is connected with the wireless receiver and emitter D9, so as to transmit a wireless signal J1 between a wireless network J and a wireless receiving and emitting device K, in order to access and transmit the digital files and multimedia files.

Some of the transmission junctions D8 are emplaced inside the casing L1, while others are located on the circuit board D. They are directly connected with digital information equipment H, and are used to access and transmit digital files and multimedia files inside the digital information equipment H.

The transmission interface D10 is connected with a hard disk F with specifications corresponding to data stored, and is used to access and transmit digital files and multimedia files inside the hard disk F.

The transmission control circuit D2 is connected with the aforementioned sockets D6, wireless transmission circuit D5, transmission junctions D8, and transmission interface D10, and is used to access and transmit digital files and multimedia files between the memory cards I to be connected, the wireless receiver and emitter D9, the digital information equipment H, and the hard disk F.

The liquid crystal display unit D4 is used to display a connection status and data processing function between the aforementioned components, so as to enable a selection of corresponding data processing function with the control button D3, and to transmit the control signal selected to the micro processor D1, which is used to process the control signal, data transmission signal, and data computation between the aforementioned components inside the circuit board D.

The touch screen E has a fixing rack E1 used to connect with the paper rack with functions of accessing and playing multimedia files L, and a fixing junction E2 used to connect with the transmission connector D11 on the paper rack L. On the other hand, the touch screen E is connected with the aforementioned micro processor D1 and transmission control circuit D2, and is used to transmit the control signal corresponding to data processing function to the aforementioned micro processor D1, and to play the digital files and multimedia files transmitted by the aforementioned transmission control circuit D2. In addition, the digital files and multimedia files are further displayed on the aforementioned liquid crystal display unit D4, and the speaker G is used to play an audio signal of the audio digital files and multimedia files.

The power junction D7 is connected with a DC/AC transformer, to transmit an external power to the circuit board D, thereby providing a working power for the aforementioned circuit board D.

Figure 9:
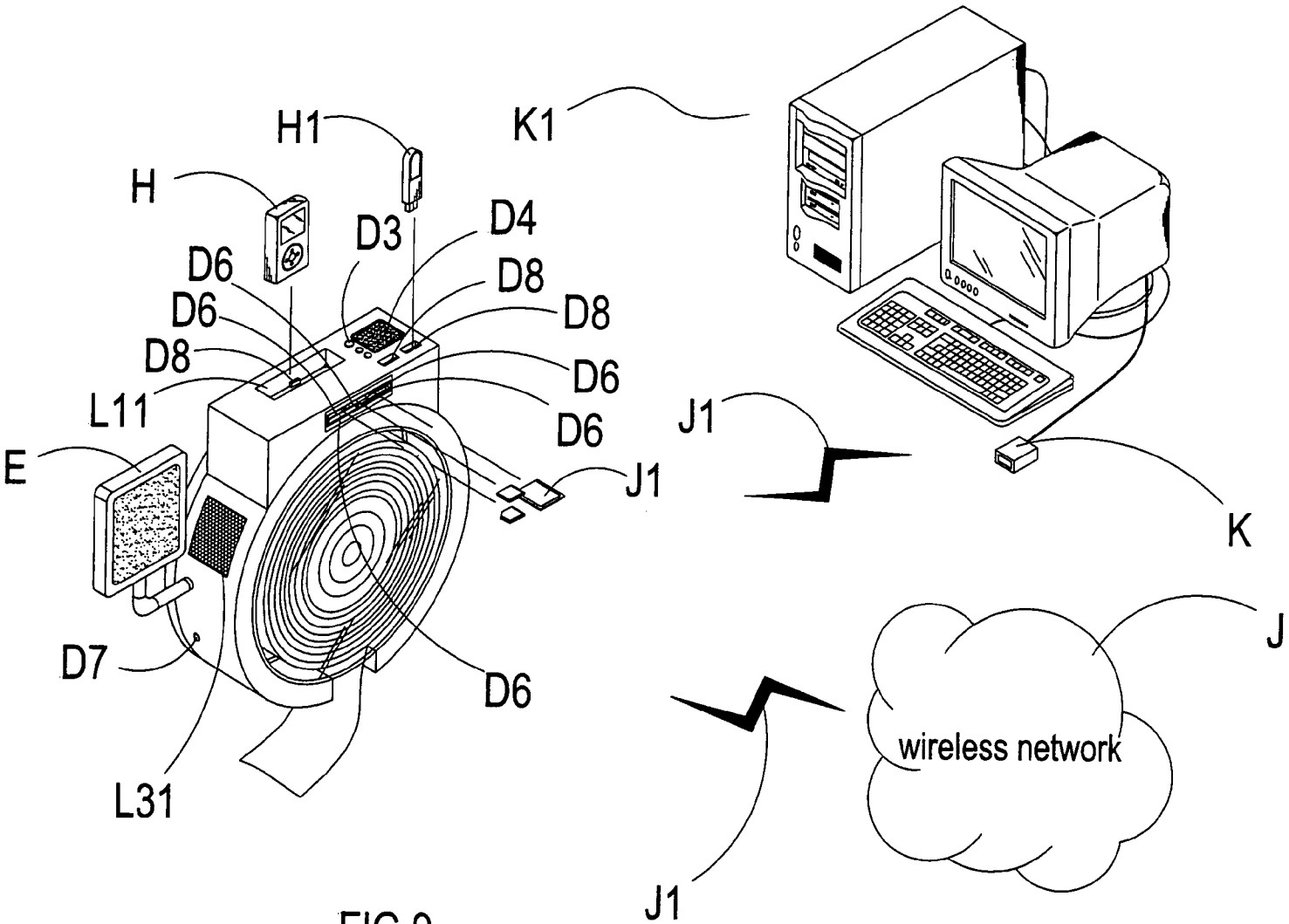
FIG. 9 shows a schematic view of still a further implementation of the present invention.

Referring to FIG. 9 (along with FIG. 4), a memory card I is inserted into a socket D6 with a corresponding specification, and a digital information equipment H is inserted on a transmission junction D8 inside a connection slot L11, whereas a portable disk H1 is inserted on another transmission junction D8.

A wireless transmission circuit D5 and a wireless receiver and emitter D9, which are installed on a circuit board D inside a paper rack with functions of accessing and playing multimedia files L, are connected with a wireless network J and an equipment having a wireless receiving and emitting device K such as a personal computer K1, and can transmit and access data with a wireless signal J1.

Of the aforementioned connection, related control such as data conversion, accessing, editing, and playing can be performed between the aforementioned devices such as the digital information equipment H, the portable disk H1, the memory card I, the wireless network, and the personal computer K1, through a touch screen E and a control button D3. Moreover, data transmission and accessing can be further performed between a hard disk F inside a paper rack with functions of accessing and playing multimedia files and the aforementioned devices. On the other hand, the touch screen E and a liquid crystal display unit D4 can display contents of digital files and multimedia files to be played, and a speaker G can play audio signals.

To further manifest the advancement and practicability of the present invention, the present invention is compared with a conventional application as follow:

Shortcomings of a conventional application

A paper rack has no extra special purposes.

Place in which a paper rack is applied, such as a bathroom, can be only used for reading a paper or magazine.

A paper rack cannot be used to increase a convenience and amusement in living.

Advantages of the present invention

It can be connected with digital information equipment.

It can be used to play multimedia files.

It can display related information of multimedia files.

It can be connected with a wireless network.

It has a function of transmitting data through wireless receiving and emitting.

It can increase a convenience and amusement in living.

It can improve a quality in living environment.

It combines a product of daily use with technology.

It has an advancement, practicability, and amusement.

It can promote an industrial competitiveness.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A paper rack with functions of accessing and playing multimedia files, wherein a circuit board is installed on a fixing piece, covered with a casing, and a speaker is installed in a containing slot at a side, covered with a casing; a micro processor, a transmission control circuit, a control button, a liquid crystal display unit, a wireless transmission circuit, sockets, a power junction, transmission junctions, a wireless receiver and emitter, a transmission interface, a connector, an audio junction, and a battery installed on the circuit board, with the power junction and connector emplaced on the rack with functions of accessing and playing multimedia files; a plurality of sockets corresponding to different specifications of memory cards connected with the memory cards of corresponding specifications, and digital files and multimedia files inside the aforementioned memory cards accessed and played; the wireless transmission circuit connected with the wireless receiver and emitter, so as to transmit a wireless signal between a wireless network and a wireless receiving and emitting device for accessing and transmitting the digital files and multimedia files; some of the transmission junctions emplaced inside the casing, others located on the circuit board, which are directly connected with digital information equipment, and are used to access and transmit digital files and multimedia files inside the digital information equipment; the transmission interface connected with a hard disk with specifications corresponding to data stored, and used to access and transmit digital files and multimedia files inside the hard disk; the transmission control circuit connected with the aforementioned sockets, wireless transmission circuit, transmission junctions, and transmission interface, and used to access and transmit digital files and multimedia files between the memory cards to be connected, the wireless receiver and emitter, the digital information equipment, and the hard disk; the liquid crystal display unit used to display a connection status and data processing function between the aforementioned components, so as to enable a selection of corresponding data processing function with the control button, and to transmit the control signal selected to the micro processor for processing the control signal, data transmission signal, and data computation between the aforementioned components inside the circuit board; the touch screen having a fixing rack for connecting with the paper rack with functions of accessing and playing multimedia files, and a fixing junction for connecting with the transmission connector on the paper rack; the touch screen connected with the aforementioned micro processor and transmission control circuit, and used to transmit the control signal corresponding to data processing function to the aforementioned micro processor, and to play the digital files and multimedia files transmitted by the aforementioned transmission control circuit; digital files and multimedia files further displayed on the aforementioned liquid crystal display unit, and the speaker G used to play an audio signal of the audio digital files and multimedia files; the aforementioned speaker G having a connecting port used to connect with the audio junction on the circuit board; the power junction connected with a DC/AC transformer, for transmitting an external power to the circuit board, thereby providing a working power for the aforementioned circuit board; a battery located on the circuit board D, so as to enable the aforementioned circuit board to operate as usual when there is no external power; the battery also be charged through the aforementioned power junction.

2. The paper rack with functions of accessing and playing multimedia files according to claim 1, wherein the transmission control circuit is further an USB-OTG circuit and a related transmission interface integrated control circuit.

3. The paper rack with functions of accessing and playing multimedia files according to claim 1, wherein the sockets are corresponding to memory cards of different specifications I, such as a CF card, a Type-I CF card, a Type-II Card, an MS card, an MGMS card, a Duo-MS card, a Pro-MS card, an MMC card, an MMC 4.0 card, a RSMMC card, an SD card, a Mini SD card, an SM card, an Xd card, and digital information storage media with related specification.

4. The paper rack with functions of accessing and playing multimedia files according to claim 1, wherein the transmission junctions are further to be an USB port, an IEEE 1394 and SATA port, and a related connection and transmission port for digital information.

5. The paper rack with functions of accessing and playing multimedia files according to claim 1, wherein the wireless transmission circuit and the wireless receiver and emitter are corresponding to different devices of wireless transmission signal, including an infra-red device, a Blue-tooth device, an FM device, an AM device, a GPRS device, a CDMA device, a GSM device, and a related device applied in wireless signal transmission techniques; the corresponding wireless network to be connected further being an 802.11 wireless network, an infrared transmission network, a Blue-tooth transmission network, an aforementioned wireless signal transmission network, and a general wireless network connected with a related wireless transmission method.

6. The paper rack with functions of accessing and playing multimedia files according to claim 1, wherein the transmission interface is corresponding to the hard disk with specifications of an IDE interface, a SCSI interface, an SATA interface, and a related hard disk transmission and connection interface.

* * * * *